US008960876B2

(12) United States Patent
Yoneta

(10) Patent No.: US 8,960,876 B2
(45) Date of Patent: Feb. 24, 2015

(54) LIQUID EJECTION HEAD AND IMAGE FORMING APPARATUS

(71) Applicant: Ryohta Yoneta, Tokyo (JP)

(72) Inventor: Ryohta Yoneta, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/324,354

(22) Filed: Jul. 7, 2014

(65) Prior Publication Data

US 2015/0015646 A1 Jan. 15, 2015

(30) Foreign Application Priority Data

Jul. 12, 2013 (JP) ..... 2013-146203

(51) Int. Cl.
*B41J 2/175* (2006.01)
*B41J 2/16* (2006.01)

(52) U.S. Cl.
CPC ..... *B41J 2/17563* (2013.01); *B41J 2/1612* (2013.01)
USPC ..... 347/93; 347/70

(58) Field of Classification Search
CPC ..... B41J 2/1612; B41J 2/1625; B41J 2002/14403; B41J 2/17563
USPC ..... 347/20, 44, 47, 54, 56, 61–65, 68, 347/70–71, 92–94
See application file for complete search history.

(56) References Cited

U.S. PATENT DOCUMENTS

| | | | | |
|---|---|---|---|---|
| 6,702,432 | B2 * | 3/2004 | Takahagi et al. | 347/70 |
| 6,761,436 | B2 * | 7/2004 | Tobita et al. | 347/70 |
| 2013/0233948 | A1 | 9/2013 | Yoneta | |
| 2014/0071215 | A1 | 3/2014 | Yoneta | |

FOREIGN PATENT DOCUMENTS

JP 2012-056262 3/2012

OTHER PUBLICATIONS

U.S. Appl. No. 14/146,078, filed Jan. 2, 2014.
U.S. Appl. No. 14/186,106, filed Feb. 21, 2014.

* cited by examiner

*Primary Examiner* — Juanita D Jackson
(74) *Attorney, Agent, or Firm* — Cooper & Dunham LLP

(57) ABSTRACT

A liquid ejection head includes nozzles ejecting liquid droplets; individual liquid chambers in communication with the nozzles; liquid supply paths in communication with the individual liquid chambers; a common liquid chamber storing liquid to be supplied to the liquid supply paths; filter members disposed between the common liquid chamber and the respective liquid supply paths, the filter members including filter regions to filter the liquid; and one or more dividing wall sections, each disposed between the liquid supply paths. Further, the filter region of the filter member is bonded to the one or more dividing wall sections and the outer peripheral parts with adhesive and the filter region of the filter member is bent in a direction opposite to a direction in which liquid flows from the common liquid chamber to the liquid supply paths.

5 Claims, 11 Drawing Sheets

LIQUID EJECTION HEAD AND IMAGE FORMING APPARATUS

CROSS-REFERENCE TO RELATED APPLICATIONS

The present application is based on and claims the benefit of priority under 35 U.S.C §119 of Japanese Patent Application No. 2013-146203 filed Jul. 12, 2013, the entire contents of which are hereby incorporated herein by reference.

BACKGROUND OF THE INVENTION

1. Field of the Invention

The present invention generally relates to a liquid ejection head and an image forming apparatus 2. Description of the Related Art As an image forming apparatus such as a printer, a facsimile machine, a copier, a plotter, and a multifunction peripheral thereof, there has been known an inkjet recording apparatus which employs a liquid ejection recording method using a recording head including a liquid ejection head (liquid droplet ejection head) which ejects liquid droplets or the like.

As the liquid ejection head, there has been known a liquid ejection head which includes a plurality of nozzles ejecting liquid droplets, a plurality of individual liquid chambers in communication with the respective nozzles, a plurality of liquid supply paths supplying liquid to the respective individual liquid chambers, a common liquid chamber in communication with the liquid supply paths (liquid introduction part), and a filter member disposed between the common liquid chamber and the liquid supply paths and having a filter region to filter liquid. Further, the filter member is bonded to flow path plates, which form the individual liquid chambers and the liquid supply paths, with adhesive (see, for example, Japanese Laid-open Patent Publication No. 2012-056262).

SUMMARY OF THE INVENTION

According to an aspect of the present invention, a liquid ejection head includes a plurality of nozzles ejecting liquid droplets; a plurality of individual liquid chambers in communication with the nozzles; a plurality of liquid supply paths in communication with the individual liquid chambers; a common liquid chamber storing liquid to be supplied to the liquid supply paths; filter members disposed between the common liquid chamber and the respective liquid supply paths, the filter members including respective filter regions to filter the liquid; and one or more dividing wall sections each disposed between the liquid supply paths.

Further, the filter region of the filter member is bonded to the one or more dividing wall sections, which are between outer peripheral parts of the filter member, and the cuter peripheral parts with adhesive in an arranged direction of the nozzles and, when viewed from a direction orthogonal to the arranged direction of the nozzles, the filter region of the filter member is bent in a direction opposite to a direction in which liquid flows from the common liquid chamber to the liquid supply paths.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In related technologies (e.g., Japanese Laid-open Patent Publication No. 2012-056262) in a technical field of a liquid ejection head used in an image forming apparatus, in a case where a filter member is bonded to flow path plates with adhesive, if adhesive protrudes on the liquid supply path side, the liquid supply path (flow path) may be narrower or may be sealed. As a result, liquid supply to refill may be delayed, which may cause nozzle down (i.e., an ejection failure).

The present invention is made in light of the problem, and it may become possible to prevent the protrusion of adhesive.

In the following, embodiments of the present invention are described with reference to the accompanying drawings. A liquid ejection head according to a first embodiment is described with reference to FIGS. 1 through 4.

Figure 1:
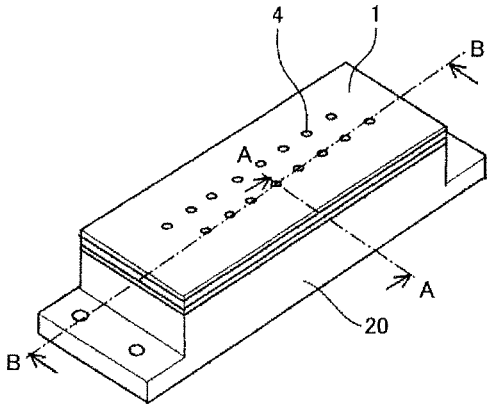
FIG. 1 is a perspective view of a liquid ejection head according to a first embodiment.
Figure 2:
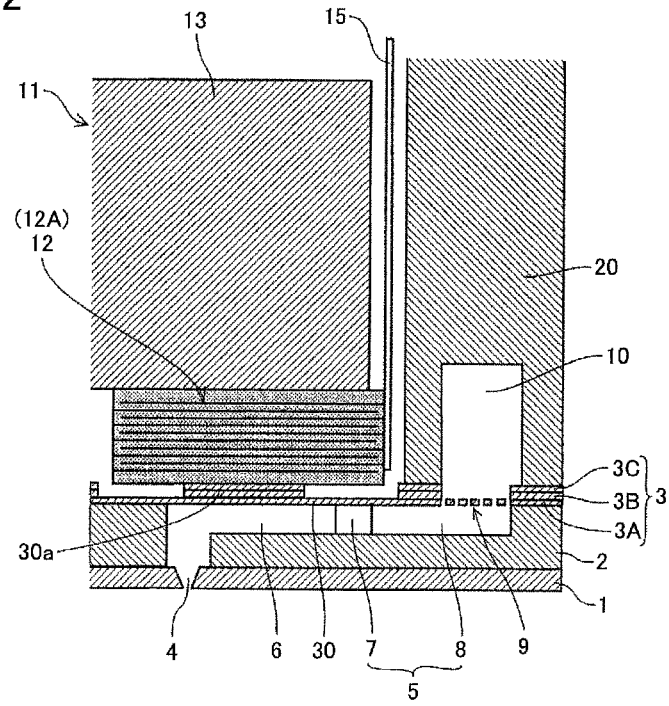
FIG. 2 is a cross-sectional view of the liquid ejection head of FIG. 1 cut along the line A-A in the direction orthogonal to a nozzle arranging direction (i.e., in the liquid chamber longitudinal direction)
Figure 3:
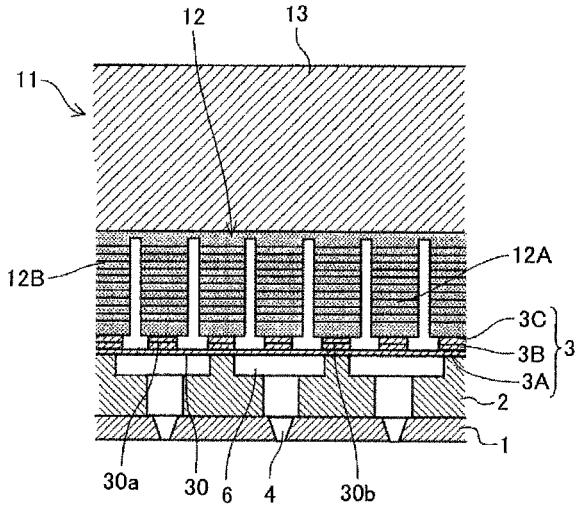
FIG. 3 is a cross-sectional view of the liquid ejection head of FIG. 1 cut along the line B-B in the nozzle arranging direction (i.e., in the liquid chamber short width direction)

FIG. 1 is a perspective view of a liquid ejection head according to a first embodiment. FIG. 2 is a cross-sectional view of the liquid ejection head of FIG. 1 cut along the line A-A in the direction orthogonal to a nozzle arranging direction (i.e., in the "liquid chamber longitudinal direction"). FIG. 3 is a cross-sectional view of the liquid ejection head of FIG. 1 cut along the line B-B in the nozzle arranging direction (i.e., in the "liquid chamber short width direction").

The liquid ejection head includes a nozzle plate 1, a flow path plate (liquid chamber substrate) 2, and a vibration plate member 3, which are laminatedly bonded together. The liquid ejection head further includes a piezoelectric actuator 11, which deforms (displaces) the vibration plate member 3, and a frame member 20 serving as a common flow path member.

By having the nozzle plate 1, the flow path plate (liquid chamber substrate) 2, and the vibration plate member 3, there are formed an individual liquid chamber 6 which is in series communication with a nozzle 4, a fluid resistance part 7 which supplies liquid to the individual liquid chamber 6, and a liquid introduction part 8 which is in communication with the fluid resistance part 7.

Further, liquid is supplied from a common liquid chamber 10, which serves as a common flow path in the frame member 20, to plural of the individual liquid chambers 6 through respective filter sections 9 which are formed in the vibration plate member 3, the respective liquid introduction parts 5, and the respective fluid resistance parts 7.

Here, the nozzle plate 1 is formed of a nickel metal plate and manufactured by an electroforming method. However, the nozzle plate 1 is not limited to this plate. For example, as the nozzle plate 1, any other metal member, a resin member, a laminated layer member including a rein layer and a metal layer, etc., may be used.

The nozzle plate 1 includes the nozzles 4 having a diameter of 10 μm to 35 μm corresponding to the individual liquid chambers 6 and is bonded to the flow path plate (liquid chamber substrate) 2 with adhesive.

Further, a water-repellent layer (not shown) is coated on a liquid droplet ejection side surface (that is, a surface in the ejection direction: ejection surface or a surface opposite to the surface on the individual liquid chamber 6 side) of the nozzle plate 1.

The flow path plate (liquid chamber substrate) 2 includes a groove part where the individual liquid chamber 6, the fluid resistance part 7, the liquid introduction part 8, etc., are formed. The groove part is formed by etching a single-crystal silicon substrate. Otherwise, for example, the flow path plate (liquid chamber substrate) 2 having such a groove part may also be formed by etching a metal plate such as a SUS substrate with acid etchant or by mechanical pressing using a pressing machine.

The vibration plate member 3 serves as not only a wall surface member, which forms a wall surface of the individual liquid chamber 6 in the flow path plate (liquid chamber substrate) 2, but also a filter member of the filter section 9. Further, the vibration plate member 3 has a multi-layer structure which includes three layers: a first layer 3A, a second layer 3B, and a third layer 3C are formed from the individual liquid chamber 6 side.

However, it should be noted that the number of the layers in the multi-layer structure of the vibration plate member 3 is not limited to three. That is, two or four or more layers may be included in the multi-layer structure of the vibration plate member 3. Further, the first layer 3A includes a deformable (displaceable) vibration region 30 that is formed at the region corresponding the individual liquid chamber 6.

Here, the vibration plate member 3 is formed of a nickel (Ni) metal plate and manufactured by an electroforming method. However, the vibration plate member 3 is not limited to such a plate. For example, as the vibration plate member 3, any other metal member, a resin member, a laminated layer member including a rein layer and a metal layer, etc., may be used.

On the side opposite to the individual liquid chamber 6 of the vibration plate member 3, there is disposed the piezoelectric actuator 11 including an electromagnetic transducer which serves as a drive means (an actuator means or a pressure generation means) to deform the vibration region 30 of the vibration plate member 3.

The piezoelectric actuator 11 includes a plurality of laminated-layer-type piezoelectric members 12 bonded to each other with adhesive and formed on a base member 13 (FIG. 2). The piezoelectric members 12 include grooves formed by half-cut dicing, so that each of the piezoelectric members 12 includes predetermined numbers of piezoelectric columns 12A and 12B formed in comb teeth-like shapes.

Here, the piezoelectric columns 12A and 12B of the are the same objects (substances) but are distinguished from each other in that the piezoelectric column 12A is a drive piezoelectric column (drive column) which is driven by a drive waveform applied thereto and the piezoelectric column 12B is a non-drive piezoelectric column (non-drive column) used as just a)non-driven) column.

Further, the piezoelectric column 12A is bonded to a convex part 30*a* which is a thick wall part formed in an island shape on the vibration region 30 of the vibration plate member 3. Further, the piezoelectric column 12B is bonded to a convex part 30*b* which is a thick wall part formed in an island shape on the vibration region 30 of the vibration plate member 3.

The piezoelectric member 12 includes piezoelectric layers and internal electrodes which are alternately laminated on each other. The internal electrodes are extended to a terminal surface to form an external electrode, which is connected to an SOC 15 as a flexible printed (wired line) circuit having flexibility to apply a drive signal to the external electrode.

The frame member 20 is formed of, for example, an epoxy type resin, a polyphenylene sulfite, which is a thermoplastic resin, or the like, so that the common liquid chamber 10, to which liquid is supplied from a head tank or a liquid cartridge (both not shown), is formed.

In the liquid ejection head having the structure described above, liquid is introduced into the individual liquid chamber 6 by, for example, lowering a voltage applied to the piezoelectric columns 12A from a reference potential so as to shrink (contract) the piezoelectric columns 12A and lift up the position of the vibration region 30 of the vibration plate member 3 to expand the capacity of the individual liquid chamber 6.

After that, the voltage applied to the piezoelectric columns 12A is increased to extend the piezoelectric columns 12A in the laminated layer direction. As a result, the vibration region 30 of the vibration plate member 3 is deformed in the nozzles 4 direction to shrink the capacity of the individual liquid chamber 6, so that pressure is applied to the liquid in the individual liquid chamber 6 and liquid droplets are ejected (injected) from the nozzle 4.

Then, by returning (setting) the voltage applied to the piezoelectric columns 12A to the reference potential, the vibration region 30 of the vibration plate member 3 is returned to its original position. Ace result, the capacity of the individual liquid chamber 6 is expanded and a negative pressure is generated in the individual liquid chamber 6, so that the individual liquid chamber 6 is refilled with liquid, which is supplied from the common liquid chamber 10 via a liquid supply path 5 (i.e., the fluid resistance part 7 and the liquid introduction part 8).

Then, after the vibration of the meniscus surface of the nozzle 4 is attenuated and stabilized, the next operation to eject droplets is started.

It should be noted that a method of driving the liquid ejection head according to an embodiment is not limited to the above example method (push-pull method). For example, a different application method in applying the drive waveform to push and pull the vibration region 30 of the vibration plate member 3 may be used.

Next, a first embodiment of the present invention is described with reference to FIGS. 4 through 8.

Figure 4:
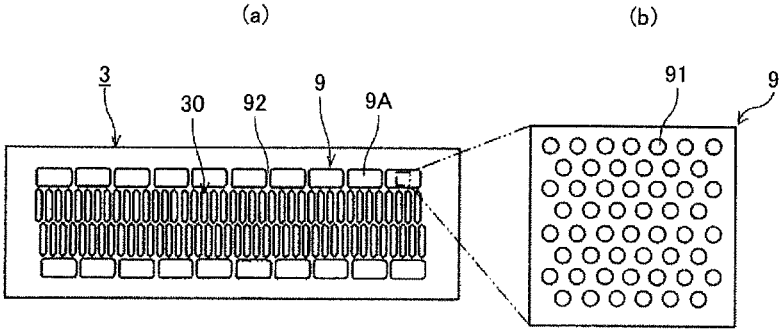
FIG. 4 is a top view and a main part enlarged view of a vibration plate member according to the first embodiment.

FIG. 4 is a top view and a main part enlarged view of the vibration plate member 3 according to the first embodiment.

Figure 5:
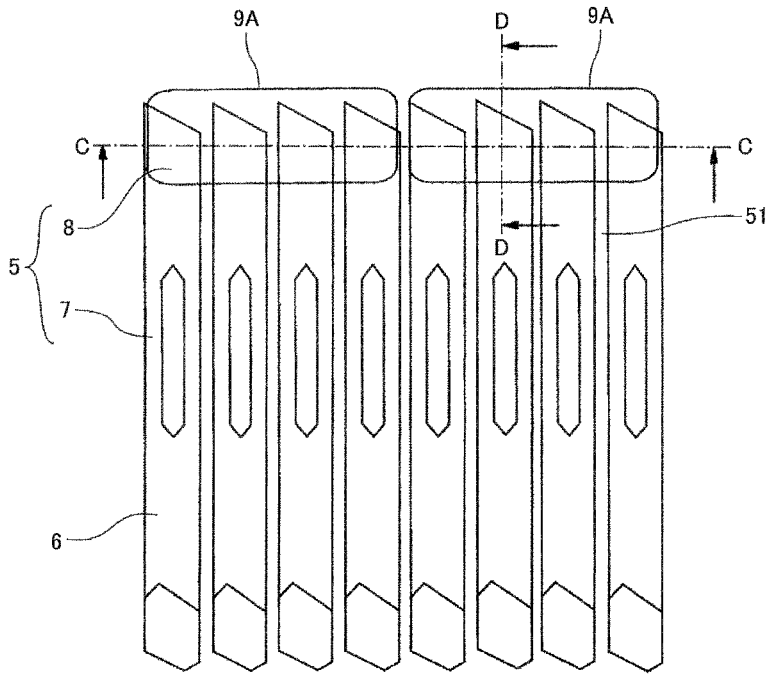
FIG. 5 is a top view of a flow path part according to the first embodiment.
Figure 6:
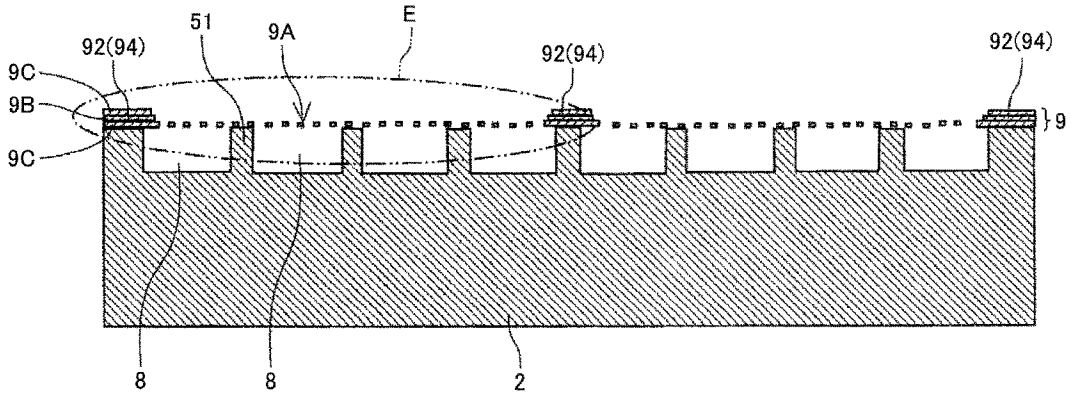
FIG. 6 is a cross-sectional view of the flow path part cut along the line C-C in FIG. 5.
Figure 7:
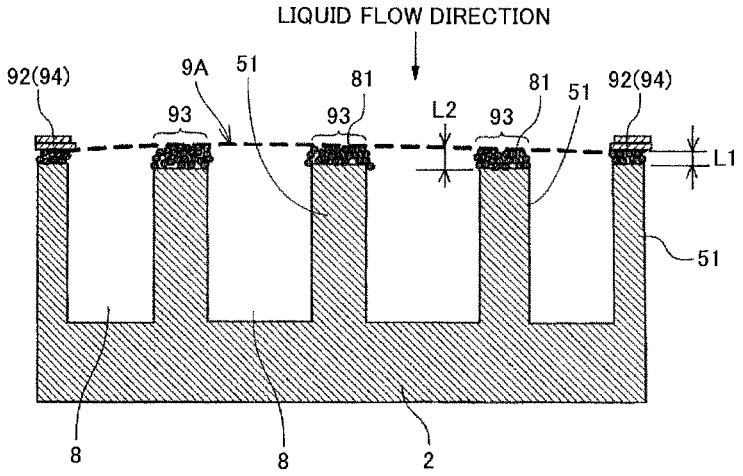
FIG. 7 is an enlarged view of the part "E" in FIG. 6.
Figure 8:
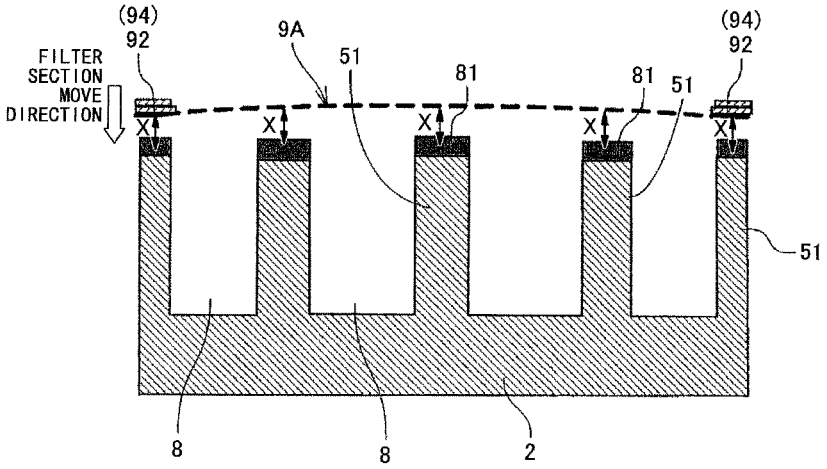
FIG. 8 is an enlarged view, similar to FIG. 7, illustrating a state before a filter section and a dividing wall section are bonded together.

FIG. 5 is a top view of a flow path part when the flow path plate (liquid chamber substrate) 2 overlaps the vibration plate member 3 according to the first embodiment. FIG. 6 is a cross-sectional view of the flow path part cut along the line C-C in FIG. 5. FIG. 7 is an enlarged view of a part "E" of FIG. 6. FIG. 8 is an enlarged view, similar to FIG. 7, illustrating a state before the filter section and a dividing wall section are bonded together. FIG. 7 schematically illustrates a filter region.

In this embodiment, as illustrated in FIG. 5, the liquid supply path 5 includes the fluid resistance part 7 and the liquid introduction part 8. Here, dividing wall sections 51 are formed between respective adjoining liquid supply paths 5.

Further, as illustrated in FIG. 2, in the vibration plate member 3, there is the filter section 9 formed between the common liquid chamber 10 and the liquid introduction part 8. Further, as illustrated in FIG. 4, a number of filter holes 91 are formed through the filter section 9, so that liquid passes (flows) through the filter holes 91.

The filter section 9 includes reinforcing regions 92, so that the reinforcing regions 92 divide the filter section 9 into a plurality of filter regions 9A, each filter region 9A corresponding to two or more liquid supply paths 5. By dividing the filter section 9 into the plural filter regions 9A by the reinforcing regions 92, it becomes possible to have (secure) strength sufficient to endure flow path pressure as a whole of the filter region 9A.

The filter region 9A is formed of the first layer 3A, and the reinforcing region 92 is formed of the second layer 3B and the third layer 3C. The reinforcing region 92 formed between adjoining filter regions 9A has a rib shape extending in the direction orthogonal to the arranging direction of the nozzles 4 (hereinafter "nozzle arranging direction"), and is integrally formed with the vibration plate member 3.

Here, as illustrated in FIG. 6, the reinforcing region 92 of the filter section 9 is formed at the position corresponding to the dividing wall sections 51 between the respective adjoining liquid supply paths 5.

Further, the reinforcing regions 92, which are disposed at the respective end parts in the nozzle arranging direction (i.e. the regions disposed outside the filter region 9A which are disposed at the respective end parts in the nozzle arranging direction), are integrated with the other regions of the vibration plate member 3. However, it is supposed that such a reinforcing region 92 is also herein called the reinforcing region 92.

Similarly, the dividing wall sections 51, which are disposed at the respective end parts in the nozzle arranging direction (i.e. the dividing walls disposed outside the liquid supply paths 5 which are disposed at the respective end parts in the nozzle arranging direction), are integrated with the other regions of the flow path plate (liquid chamber substrate) 2. However, it is supposed that such a dividing wall section 51 is also herein called the dividing wall section 51.

Further, as illustrated in FIG. 7, in the nozzle arranging direction, outer peripheral parts 94, which are formed of the respective reinforcing regions 92, are bonded to, for example, the respective dividing wall sections 51 formed of the flow path plate 2 with adhesive 81. Further, in the filter region 9A, the filter region 9A is bonded to the dividing wall sections 51 formed of the flow path plate 2 with adhesive 81.

Here, the filter region 9A is bent when viewed from a direction orthogonal to the nozzle arranging direction (as illustrated in FIG. 7) in a manner that the center of the filter region 9A, which is in regions 93 facing the dividing wall section 51 (FIG. 7), protrudes towards the upstream (common liquid chamber 10) side in the liquid flow direction which is from the common liquid chamber 10 to the liquid supply path 5 (liquid introduction part 8).

FIG. 7 illustrates a case where the filter region 9A is bent in the direction opposite to the direction in which liquid flows from the common liquid chamber 10 to the liquid supply path 5 (liquid introduction part 8) not only in the regions 93 facing the dividing wall section 51 but also in regions facing the liquid supply paths 5 (liquid introduction parts 8) between the respective adjoining dividing wall sections 51.

Due to the bending of the filter region 9A, it becomes possible to reduce an amount of pressure by the filter region 9A applied to adhesive 81 at the portions where the filter region 9A is bonded to the dividing wall sections 51, so that it becomes possible to reduce an amount of adhesive 81 that protrudes into a flow path such as on the liquid introduction part 8 side, etc.

In other words, since the filter region 9A of the filter section 9 is bent in the direction opposite to the direction in which liquid flows from the common liquid chamber 10 to the liquid supply path 5 (liquid introduction part 8) (in a manner that the center part of the filter region 9A protrudes towards the upstream (common liquid chamber 10) side in the liquid flow direction), as illustrated in FIG. 7, a distance "L2" between the dividing wall sections 51 and the regions 93 of the filter region 9A facing the dividing wall sections 51 becomes greater than a distance "L1" between the dividing wall sections 51 and the outer peripheral parts 94 of the filter region 9A facing the dividing wall sections 51.

This point is described in more detail by referring to a bonding step of bonding the filter section 9 to the dividing wall sections 51 with reference to FIG. 8. FIG. 8 illustrates a state before the filter section 9 is bonded to the dividing wall sections 51.

The filter section 9 is moved toward bonding surfaces of the dividing wall sections 51 on which adhesive 81 is applied. Then, the filter region 9A and the outer peripheral parts 94 of the filter region 9A are in contact with adhesive 81 on the dividing wall sections 51. Then, when pressure is applied to the outer peripheral parts 94, the filter region 9A and the cuter peripheral parts 94 are bonded to the dividing wall sections 51 with adhesive 81.

In the bonding process, the filter region 9A and the outer peripheral parts 94 are displaced by a distance "X" (FIG. 8). In this case, however, a distance (e.g., "L1") between the outer peripheral parts 94 of the filter region 9A and the dividing wall sections 51 under the outer peripheral parts 94 is less than a distance (e.g., "L2") between the filter region 9A and the dividing wall sections 51 under the filter region 9A in the regions 93 where the filter region 9A (excluding the outer peripheral parts 94) faces the dividing wall sections 51 (FIGS. 7 and 8).

Due to the difference in distances (e.g., "L2>L1" in FIG. 7), when the filter region 9A is displaced by the distance "X", the amount of adhesive 81 that protrudes from the top of the dividing wall sections 51 in the regions 93 is less than a amount of adhesive 81 that protrudes from the top of the dividing wall sections 51 at the outer peripheral parts 94. Accordingly, it becomes possible to reduce an amount of adhesive 81 that flows into the liquid introduction part 8 or the like. In other words, it becomes possible to effectively prevent the adhesive 81 from flowing into the liquid introduction part 8 or the like.

Figure 9:
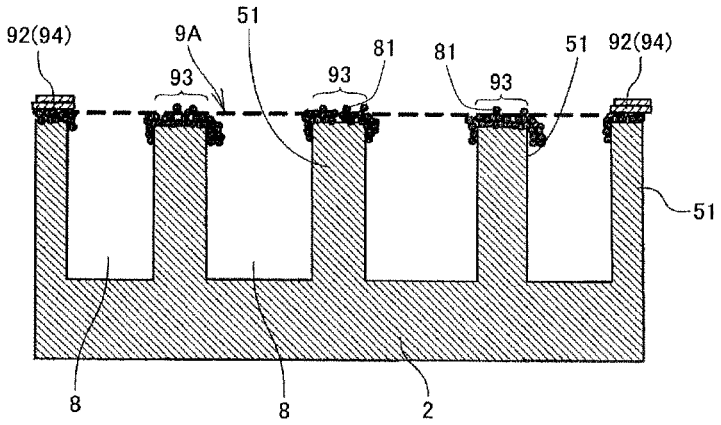
FIG. 9 is an enlarged cross-sectional view of a comparative example.

FIG. 9 is an enlarged cross-sectional view of a configuration of a comparative example where the regions 93, which face the dividing wall sections 51, do not cause the filter region 9A to be bent (i.e., a contact surface of the filter region 9A including its outer peripheral parts 94 of the filter section 9 to be in contact with the dividing wall sections 51 is uniformly flat).

In this case, obviously, when the filter section 9 is in contact with the dividing wall sections 51, the filter section 9 is moved toward the dividing wall sections 51 while a distance between the filter region 9A and the dividing wall sections 51 at the outer peripheral parts 94 is kept to be the same as the distance between filter region 9A and the dividing wall sections 51 in the regions 93 which are the regions other than the outer peripheral parts 94.

As a result, when the filter region 9A is bonded to the dividing wall sections 51 with adhesive 81, the amount of adhesive 81 that protrudes from the top of the dividing wall section 51 in the regions 93 into the liquid supply path 5 may become substantially the same as the amount of adhesive 81 that protrudes from the top of the dividing wall section 51 at the outer peripheral part 94 into the liquid supply path 5.

As described, when adhesive 81 flows into the liquid supply path 5 or the like, the liquid supply path 5 or the like may be narrower or sealed. As a result, liquid supply to refill the individual liquid chambers 6 may be delayed, which may cause an ejection failure.

Figure 10:
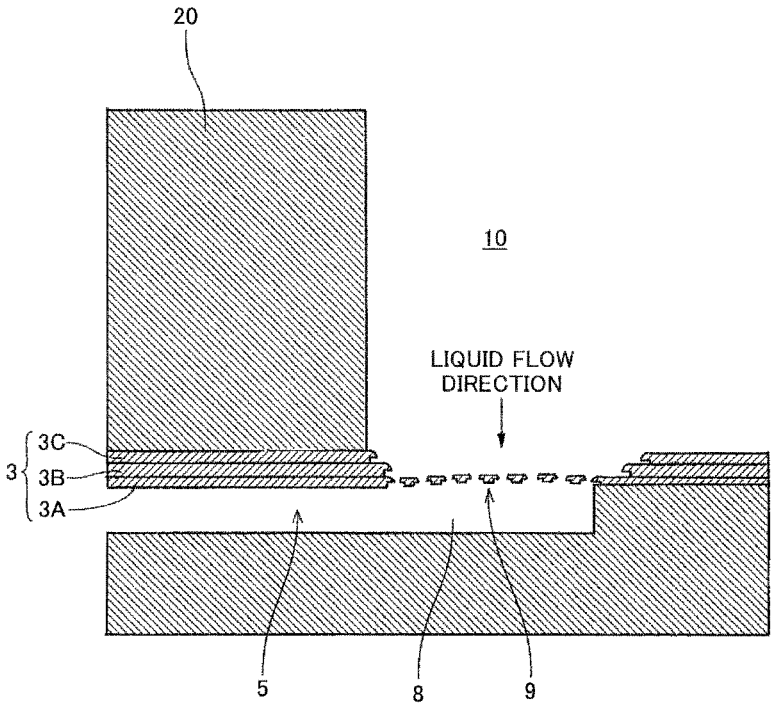
FIG. 10 is a cross-sectional view of the flow path part cut along the line D-D in FIG. 5.

Further, as schematically illustrated in FIG. 10, the filter region 9A may (also) be bent in the direction orthogonal to the nozzle arranging direction so as to be bent in the direction opposite to the direction in which liquid flows from the common liquid chamber 10 to the liquid introduction part 8.

In other words, the filter region 9A may (also) be bent when viewed in the nozzle arranging direction in a manner that the center of the filter region 9A (the filter section 9) protrudes toward the upstream (common liquid chamber 10) side in the liquid flow direction which is from the common liquid chamber 10 to the liquid introduction part 8.

As described, when the filter region 9A of the filter section 9 (filter member) is bent in the direction opposite to the direction in which liquid flows from the common liquid chamber 10 to the liquid introduction part 8 in the regions 93 facing the dividing well section 51 (i.e., the filter region 9A is bent (protrudes) toward the common liquid chamber 10 side) or when the distance (e.g., "L1" of FIG. 7) between the outer peripheral parts 94 of the filter region 9A and the dividing wall sections 51 under the outer peripheral parts 94 is less than the distance (e.g., "L2") between the filter region 9A and the dividing wall sections 51 under the filter region 9A in the regions 93 where the filter region 9A (excluding the outer peripheral parts 94) faces the dividing wall sections 51, it becomes possible to reduce the amount of adhesive 81 that flows into the flow path on the liquid supply path 5 side.

Figure 11:
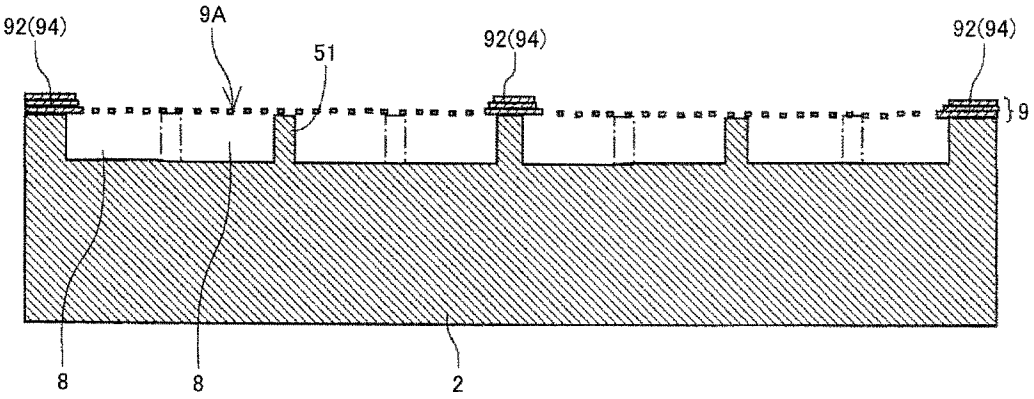
FIG. 11 is a cross-sectional view of the flow path part when cut along the line C-C in FIG. 5 according to a second embodiment.
Figure 12:
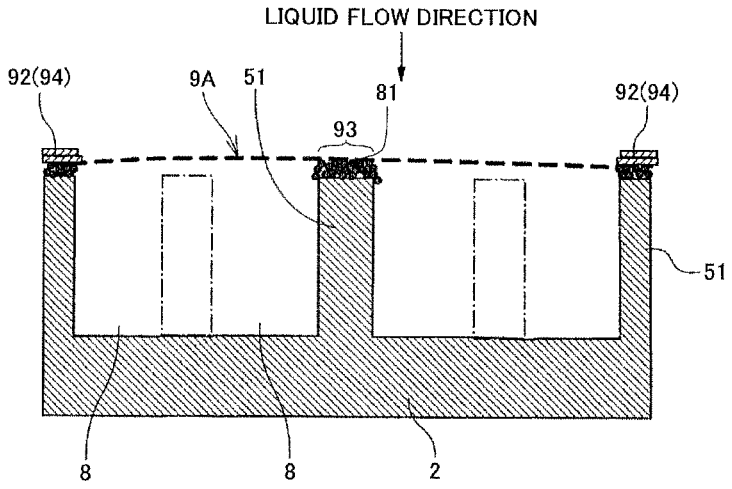
FIG. 12 is an enlarged view of FIG. 11 according to the second embodiment.

Next, a second embodiment of the present invention is described with reference to FIGS. 11 and 12. FIG. 11 is a cross-sectional view of the flow path part when cut along the line C-C in FIG. 5 according to the second embodiment. FIG. 12 is an enlarged view of FIG. 11 according to the second embodiment, similar to FIG. 7.

In the second embodiment, two or more liquid introduction parts 8 of the liquid supply paths 5 are in communication with each other, so that the two or more liquid introduction parts 8 are collectively defined by the adjoining dividing wall sections 51. The configuration other than this structure is the same as the configuration in the first embodiment described above.

By having the structure according to the second embodiment as described above, the same effect as that in the first embodiment may be achieved.

Figure 13:
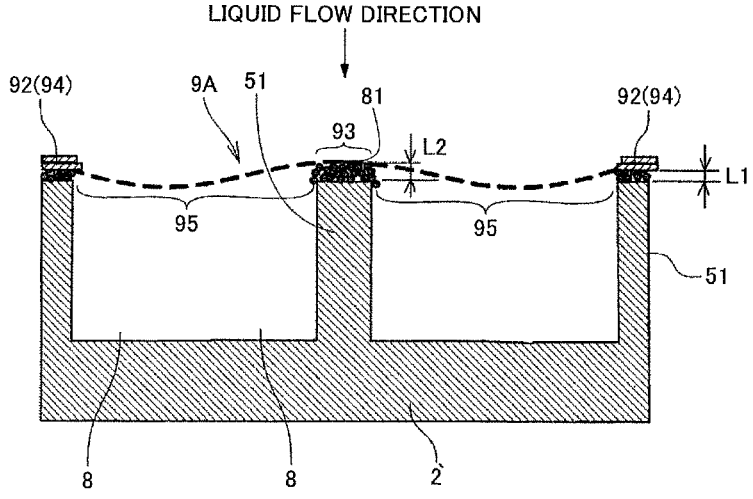
FIG. 13 is an enlarged view according to a third embodiment.

Next, a third embodiment of the present invention is described with reference to FIG. 13. FIG. 13 is an enlarged view according to the third embodiment similar to FIG. 7.

In this embodiment, the filter region 9A of the filter section 9 has a corrugated (waved) shape in the nozzle arranging direction (when viewed from a direction orthogonal to the nozzle arranging direction).

More specifically, the filter region 9A is bent in the direction opposite to the direction in which liquid flows from the common liquid chamber 10 to the liquid supply path 5 (liquid introduction part 8) (i.e., bent upward in FIG. 13) in the region 93. On the other hand, there exists a part where the filter region 9A is bent in the direction in which liquid flows from the common liquid chamber 10 to the liquid supply path 5 (liquid introduction part 8) (i.e., bent downward in FIG. 13) in regions 95.

Further, the filter region 9A is formed in a manner that parts of the filter region 9A that are bent in the direction opposite to the direction in which liquid flows from the common liquid chamber 10 to the liquid supply path 5 (i.e., bent upward in FIG. 13) are in contact with the dividing wall sections 51 (which include the dividing wall sections 51 in contact with the outer peripheral parts 94 of the filter region 9A).

In addition, similar to the first embodiment, in the nozzle arranging direction, the distance "L2" between the dividing wall section 51 and the region 93 of the filter region 9A facing the dividing wall section 51 is set to be greater than a distance "L1" between the dividing wall section 51 and the cuter peripheral parts 94 of the filter region 9A facing the dividing wall section 51.

By having the structure according to the second embodiment as described above, the same effect as that in the first embodiment may be achieved.

In this embodiment, the filter region 9A may be bent in the direction opposite to the direction in which liquid flows from the common liquid chamber 10 to the liquid supply path 5 (i.e., bent upward in FIG. 13) across two or more regions 93. Namely, the number of the regions 93 where the filter region 9A is bent upward between the outer peripheral parts 94 of the filter region 9A is not limited to one.

Figure 14:
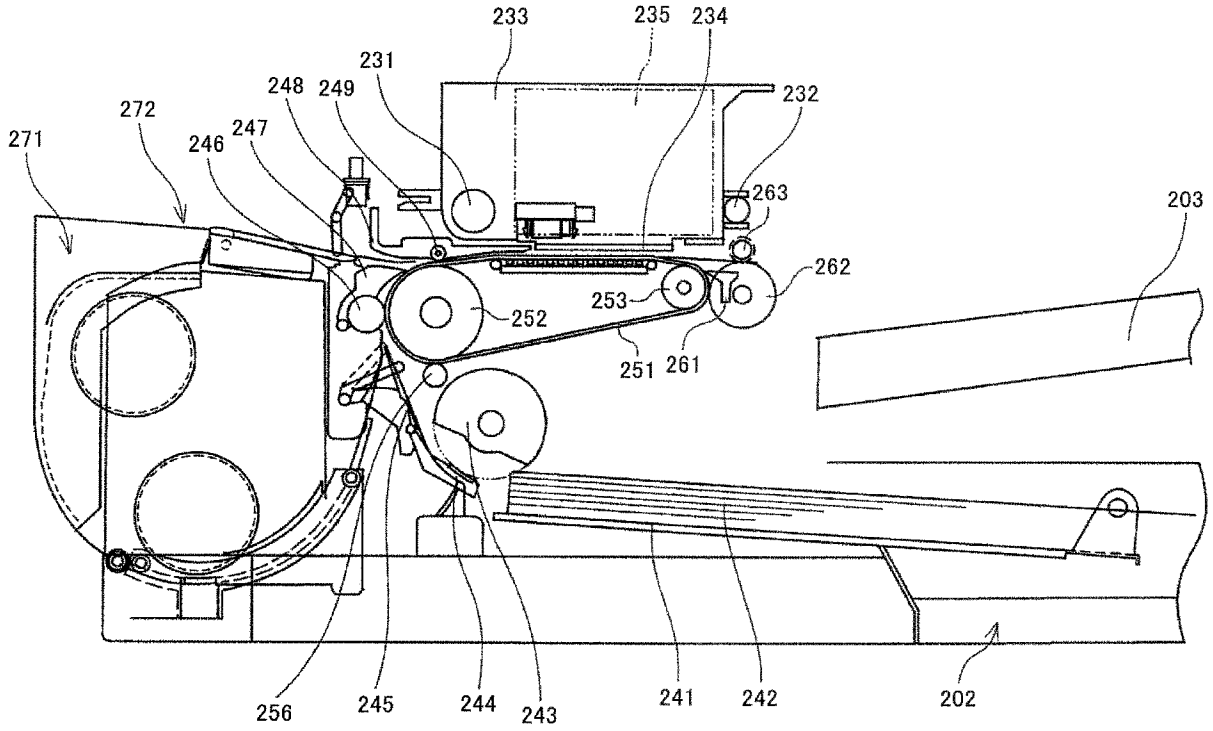
FIG. 14 is a side view of a mechanical part of an image forming apparatus according to an embodiment.
Figure 15:
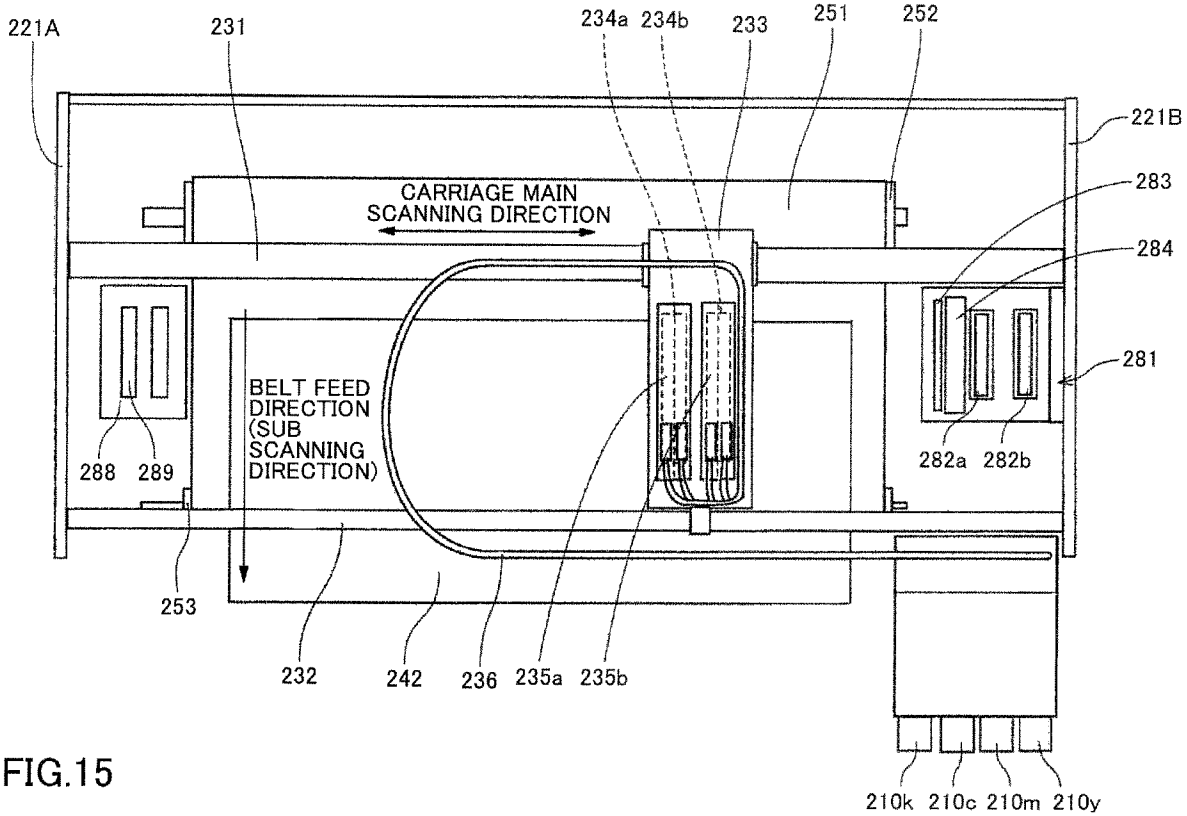
FIG. 15 is a top view of a main part of the mechanical part.

Next, an example image forming apparatus including the liquid ejection head according to an embodiment is described with reference to FIGS. 14 and 15. FIG. 14 is a side view of a mechanical part of an image forming apparatus according to an embodiment and FIG. 15 is a top view of a main part of the mechanical part.

The example of the image forming apparatus is known as a serial-type image forming apparatus. As illustrated in FIG. 15, the image forming apparatus includes left and right side plates 221A an 221B, main and sub guide 231 and 232, respectively, bridged between the left and right side plates 221A an 221B, and a carriage 233 that is slidably supported in the arrow direction of FIG. 15 (i.e., the "(carriage) main scanning direction") by the main and sub guide rods 231 and 232. The carriage 233 is driven to move in the arrow direction the "(carriage) main scanning direction") by a main scanning motor (not shown) via a timing belt (also not shown).

The carriage 233 includes recording heads 234 in which the liquid ejection heads ejecting yellow (Y), cyan (C), magenta (M), and black (K) color ink according to an embodiment and tanks to supply respective color ink to the respective liquid ejection heads. The recording heads 234 include nozzle arrays, each including a plurality of nozzles, arranged in the sub scanning direction orthogonal to the main scanning direction, so that ink droplets can be ejected downward from the nozzles.

More specifically, as recording heads 234, there are two recording heads 234*a* and 234*b*. The recording heads 234*a* and 234*b* include respective two nozzle arrays. The recording head 234*a* includes a nozzle array ejecting black (K) liquid (ink) droplets and a nozzle array ejecting cyan (C) liquid (ink) droplets. On the other hand, the recording head 234*b* includes a nozzle array ejecting magenta (M) liquid (ink) droplets and a nozzle array ejecting yellow (Y) liquid (ink) droplets. Here, the case is described where four color liquid droplets are ejected using two recording heads. However, for example, the four color liquid droplets may be ejected using a single recording head.

The four colors of ink are supplied from the ink cartridges 210 to the tanks 235 in the recording heads 234 via supply tubes, respectively, by a supply unit.

On the other hand, as a sheet feeding section to supply sheets 242 stacked on a sheet load section (pressurizing plate) 241 of a sheet tray 202, there are a semicircular roller (sheet feeding roller) 243 and a separation pad 244 facing the sheet feeding roller 243 to separate the sheets 242 one by one from the sheet load section 241.

Further, to feed the sheet 242 fed from the sheet feeding section under the recording heads 234, there are provided a guide 245 to guide the sheets 242, a counter roller 246, a feed guide member 247, and a pressing member 248 including a tip pressure roller 249. Further, there is a feed belt 251 as a feed unit to electrostatically adsorb (attract) and feed the fed sheet 242 at the position facing the recording heads 234.

The feed belt 251 is an endless belt bridged between a feed roller 252 and a tension roller 253 so as to be rotated in the belt feed direction (i.e., the sub scanning direction). Further, there is a charge roller 256 as a charge unit to charge a surface of the feed belt 251. The charge roller 256 is in contact with a surface layer of the feed belt 251 and is driven to rotate by the rotation of the feed belt 251. The feed belt 251 is driven to rotate and move in the belt feed direction at a timing by the rotation of the feed roller 252 which is driven to rotate by a sub scanning motor (not shown).

Further, as a sheet discharge section to discharge the sheet 242 on which an image is recorded by the recording heads 234, there are a separation claw 261 to separate the sheet 242 from the feed belt 251, a discharge roller 262, and a discharge roller 263. Further, a discharge tray 203 is disposed under the discharge roller 262.

Further, a double sided unit 271 is detachably provided on a rear surface section of an apparatus main body. The double sided unit 271 receives the sheet 242 which is fed back by the reverse rotation of the feed belt 251, inverts the sheet 242, and feeds the inverted sheet 242 between the counter roller 246 and the feed belt 251 again. Further, the upper surface of the double sided unit 271 is used as a manual tray 272.

Further, there is a maintenance and recovery mechanism 281 disposed in a non-print region on one side in the scanning direction of the carriage 233 to maintain and recover the state of the nozzles of the recording heads 234.

The maintenance and recovery mechanism 281 includes cap members 282*a* and 282*b* (which may be collectively referred to as "cap member(s) 282") to cap the nozzle surfaces of the recording heads 234. The maintenance and recovery mechanism 281 further includes a wiper blade 283 as a blade member to wipe the nozzle surfaces. The maintenance and recovery mechanism 281 further includes a preliminary ejection ink receiver 284 to receive ink droplets preliminary ejected which do not contribute to recording images in order to preliminarily eject recording droplets (ink) having increased viscosity.

Further, in a non-print region on the other side in the scanning direction of the carriage 233, there is a preliminary ejection ink receiver 288 to receive ink droplets preliminary ejected which do not contribute to recording images in order to preliminarily eject recording droplets (ink) having increased viscosity during recording and the like. The preliminary ejection ink receiver 288 includes openings 289 extending in the nozzle arranging direction of the recording heads 234.

In an image forming apparatus having the structure described above, the sheet 242 is separated one by one from the sheet tray 202 and substantially vertically fed so as to be guided by the guide 245 and sandwiched between the feed belt 251 and the counter roller 246 to be further fed. Then, the head of the sheet 242 is guided by a feed guide 237 and pressed to the feed belt 251 by the tip pressure roller 249 so the feed direction of the sheet 242 is changed by approximately 90 degrees.

Then, when the sheet 242 is fed onto the charged surface of the feed belt 251, the sheet 242 is electrostatically adsorbed (attracted) by the feed belt 251 and fed in the sub scanning direction by the rotation and feed of the feed belt 251.

At the same time, while the carriage 233 is moved, the recording heads 234 are driven in accordance with an image signal, and one line of an image is recorded on the stopped sheet 242 by ejecting ink droplets on the sheet 242. Then the sheet 242 is fed a predetermined distance for recording the next line. The recording operation is terminated when a record end signal or a signal indicating that the rear end of the sheet 242 reaches a recording region is received, so that the sheet 242 is discharged to the discharge tray 203.

As described above, the image forming apparatus includes a liquid ejection head according to an embodiment. Therefore, it becomes possible to stably form a high-quality image.

In the present application, the material of the "sheet" is not limited to a paper alone. The material of the "sheet" may include, for example, a material of an OHP (Over Head Projector) sheet, fiber (cloth), glass, a substrate or the like to which liquid including ink droplets may be adhered. Further, the "sheet" may be a material called a "medium to be recorded", a "recording medium", a "recording sheet", a "recording paper" and the like. Further, it is assumed that the terms "image formation", "recording", "printing", "print", "image printing" and the like are synonymous words.

Further, the term "image forming apparatus" refers to an apparatus performing image formation by discharging liquid onto a medium including a paper, strings, fibers, cloth, leather, metal, plastic, glass, wood, ceramic or the like. Further, the term "image formation" refers not only to applications of an image having a meaning such as a character, a figure or the like but also to the application of meaningless images to a medium (e.g., simply discharging liquid droplets to a medium).

The term "ink" is not limited to a liquid called "ink" unless otherwise described and is collectively used to represent all the materials that are called "recording liquid", "fixing treatment liquid", "liquid" and the like and that are used for image formation. Therefore, the term "ink" may include a "DNA sample", "resist", "pattern material", "resin" and the like.

Further, the "image" is not limited to a planate object but includes an image applied on a medium and the like which are three-dimensionally formed, and an image formed by three-dimensionally molding a solid object.

Further, unless otherwise described, the image forming apparatus includes both a serial-type image forming apparatus and a line-type image forming apparatus.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A liquid ejection head comprising:

a plurality of nozzles configured to eject liquid droplets;

a plurality of individual liquid chambers communication with the nozzles;

a plurality of liquid supply paths in communication with the individual liquid chambers;

a common liquid chamber configured to store liquid to be supplied to the liquid supply paths;

filter members disposed between the common liquid chamber and the respective liquid supply paths, the filter members including respective filter regions to filter the liquid; and one or more dividing wall sections each disposed between the liquid supply paths, wherein the filter region of the filter member is bonded to the one or more dividing wall sections, which are between outer peripheral parts of the filter member, the outer peripheral parts with adhesive being in an arranged direction of the nozzles and wherein, when viewed from a direction orthogonal to the arranged direction of the nozzles, the filter region of the filter member is bent in a direction opposite to a direction in which liquid flows from the common liquid chamber to the liquid supply paths.

2. The liquid ejection head according to claim 1, wherein, when viewed from the direction orthogonal to the arranged direction of the nozzles, the filter region of the filter member is bent in the direction in which liquid flows from the common liquid chamber to the liquid supply paths in a region where the filter region faces one or more of the liquid supply paths.

3. The liquid ejection head according to claim 1, wherein the filter region of the filter member is bent in the direction opposite to the direction in which liquid flows from the common liquid chamber to the liquid supply paths across two or more dividing wall sections.

4. The liquid ejection head according to claim 1, wherein, when viewed from the direction orthogonal to the arranged direction of the nozzles, the filter region of the filter member is defined by reinforcing regions and wherein the reinforcing regions correspond to the outer peripheral parts of the filter region.

5. An image forming apparatus comprising:

the liquid ejection head according to claim 1.

* * * * *